US005621929A

United States Patent [19]

Smith

[11] Patent Number: 5,621,929

[45] Date of Patent: Apr. 22, 1997

[54] WORK STATION

[75] Inventor: John W. Smith, Hessle, England

[73] Assignee: Afos Limited, England

[21] Appl. No.: 400,135

[22] Filed: Mar. 6, 1995

Related U.S. Application Data

[63] Continuation of Ser. No. 83,904, Jun. 25, 1993, abandoned.

[30] Foreign Application Priority Data

Jun. 25, 1992 [GB] United Kingdom ..... 9213533

[51] Int. Cl.[6] ..... E03C 1/01

[52] U.S. Cl. ..... 4/640; 4/631; 4/638; 454/49; 134/902; 312/209

[58] Field of Search ..... 4/631–641, 209 R, 4/209 FF; 454/49, 187, 66, 54; 134/902, 105; 55/DIG. 18; 126/21 R, 37 R

[56] References Cited

U.S. PATENT DOCUMENTS

| | | | |
|---|---|---|---|
| 964,857 | 7/1910 | Fredenhagen | 4/638 |
| 2,334,776 | 11/1943 | King et al. | 312/209 |
| 2,784,418 | 3/1957 | Louma | 4/640 |
| 3,303,839 | 2/1967 | Tavan | 55/DIG. 18 |
| 3,756,217 | 9/1973 | Field | 454/49 |
| 4,220,078 | 9/1980 | Walker et al. | 454/54 |
| 4,305,166 | 12/1981 | Rose | 4/631 |
| 4,369,532 | 1/1983 | Houchins et al. | 4/639 |
| 4,537,120 | 8/1985 | Josefsson | 454/54 |
| 4,600,148 | 7/1986 | Raymer et al. | 4/632 |
| 4,624,020 | 11/1986 | Abderhalden et al. | 4/637 |
| 4,633,850 | 1/1987 | Hawkins et al. | 126/21 R |
| 4,650,171 | 3/1987 | Howorth | 454/49 |
| 4,665,893 | 5/1987 | Miyagawa et al. | 126/21 R |
| 4,846,146 | 7/1989 | Tucker et al. | 454/66 |
| 4,898,089 | 2/1990 | Roos | 454/49 |
| 4,998,306 | 3/1991 | Klimke et al. | 4/638 |
| 5,240,018 | 8/1993 | Clark et al. | 135/902 |

FOREIGN PATENT DOCUMENTS

| | | | |
|---|---|---|---|
| 2153254 | 8/1985 | United Kingdom | 312/209 |

*Primary Examiner*—Henry J. Recla
*Assistant Examiner*—Gregory M. Vidovich
*Attorney, Agent, or Firm*—Nawrocki, Rooney & Sivertson, P.A.

[57] ABSTRACT

A work station comprising a support unit which includes a liquid collection surface with a drain outlet, and which provides a support surface; at least at least one work facility, such as a sink or a drainage surface, mounted removably in the support unit on the support surface, the work facility having a drain outlet through which liquid can drain from the work facility onto the collection surface of the support unit, for collection for the drain outlet provided therein.

7 Claims, 1 Drawing Sheet

WORK STATION

This is a continuation of application Ser. No. 08/083,904 filed on Jun. 25, 1993, now abandoned.

BACKGROUND TO THE INVENTION

This invention relates to a work station which includes a liquid collection surface with a drain outlet, and to a ventilated work station.

Work stations which can accommodate liquid or other waste for disposal can be required to be capable of being used for many tasks, including washing, draining, preparation of materials and so on. Frequently, the requirements placed on the configuration of the work station change according to the particular task that is to be performed.

SUMMARY OF THE INVENTION

The present invention provides a work station in which a work facility is provided which can be removed so that it can be interchanged with another facility.

Accordingly, in one aspect, the invention provides a work station which comprises:

(a) a support unit which includes a liquid collection surface with a drain outlet, and which provides a support surface; and (b) at least one work facility mounted removably in the support unit on the support surface, the work facility having a drain outlet through which liquid can drain from the work facility onto the collection surface of the support unit, for collection for the drain outlet provided therein.

The work station of the invention has the advantage that it can be adapted easily to suit a particular task that is to be performed at it, while still allowing liquid waste (or other waste that can be disposed of with liquid waste) from the work facility in use to be collected. Work facilities can be placed on the support unit, and interchanged or moved relative to one another and the support unit as required. Thus for example, it might be appropriate for one task for the work station to accommodate one sink and a drainage surface. In another situation, it might be appropriate for the work station to accommodate two sinks, each of which might, for example, include an integral drainage surface. The work station can be adapted between these two configurations simply by replacement of the work facilities that provide the sinks and the drainage surfaces, as the case might be.

The work station can include two or more work facilities mounted removably in the support unit, of which at least one has a drain outlet through which liquid can drain from the work facility onto the collection surface of the support unit, for collection for the drain outlet provided therein. The work station can include one or more removable support elements which can be placed between adjacent work facilities to support them.

The work facility can comprise a sink, which might, for example, have a draining surface formed integrally with it on which articles can be placed for liquid to drain from them.

The work facility can comprise a drainage surface, on which articles can be placed for liquid to drain from them.

The work facility can comprise a substantially flat surface, for example such as might be used for preparation of materials, perhaps when the materials need to be cut. The flat surface might include formations, such as a groove around its perimeter for collection of liquid which must be drained from the facility.

Preferably, the work station includes openings formed in the support unit for ventilation of the atmosphere in the vicinity of the work facility. The openings can be formed in the support surface of the support unit, along one or more edge portions of the support surface, for example along two opposite edges of a rectangular support unit. More preferably, openings are provided around approximately the entire periphery of the support surface. When the work station includes more than one work facility, it can be preferred for ventilation openings to be provided between adjacent work facilities. Such openings can be provided in a support element which extend across the work station between adjacent work facilities.

The ventilation openings can be provided in an upstanding wall.

Preferably, the openings in the support unit communicate with a plenum chamber.

The work station can include a device for ventilating the work facility, such as a fan.

Preferably, the liquid collection surface is a surface of the plenum chamber.

Preferably, the work station includes at least one valve, such as a tap or faucet, by which the supply of fluid to the work facilities can be controlled. The fluid might be, for example, water or another solvent, or a cleaning material such as a detergent.

DETAILED DESCRIPTION OF THE INVENTION

Figure 1:
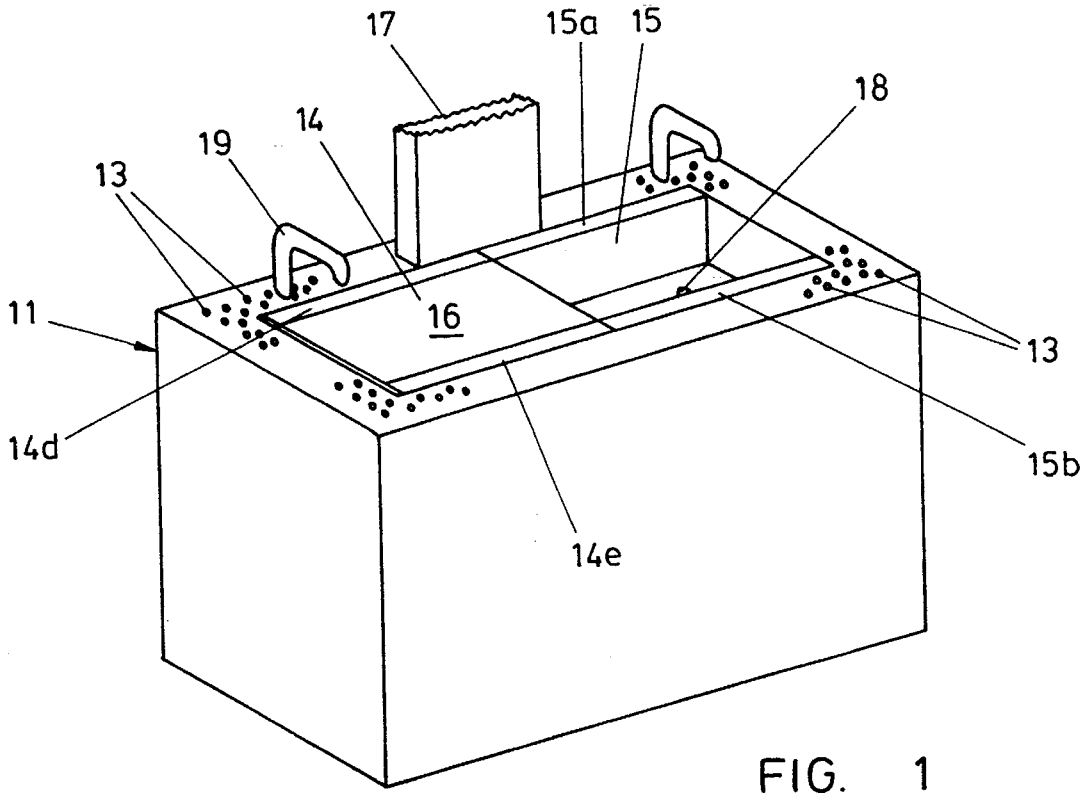
FIG. 1 is a schematic isometric view of a work station.

FIG. 1 shows a generally rectangular cabinet 11 whose upper regions are closed by a plenum chamber 12 which comprises a flange 12*a*, the outer edge regions of which are supported by the cabinet 11, with a central depression 12*b* within the flange 12*a*.

The flange 12*a* defines an outwardly extending flange 12*c* and an inwardly directed flange 12*d*. The outwardly directed flange 12*c* seats on top of a frame 11*a* for the cabinet 11 and the flange 12*d* extends inwardly from the wall of the recess 12*b* and includes ventilating apertures 13.

The flange parts 12*c* and 12*d* lie in a common, substantially horizontal plane, and the central opening into the plenum chamber 12, defined by the inner peripheral edge of flange 12*d*, is closed by two work facilities 14 and 15.

The work facility 14 presents a relatively flat top and conveniently comprises a shallow metal trough defined by a base 14*a*, upstanding parallel walls 14*b* and 14*c*, and flanges 14*d* and 14*e* outwardly depending. The flanges 14*d* and 14*e* lie parallel to the base 14*a* and the trough is so arranged that the depressed central region, defined by base 14*a*, and upstanding walls 14*b* and 14*c*, fits neatly into the central opening defined by the inner edge of flange 12*d*, with the flanges 14*d* and 14*e*resting on the flange 12*d*.

A block of solid material 16, preferable inert with respect to the work tasks to be performed thereon, fits neatly into the recess defined by the trough 14.

The block 16 may present its upper surface in the plane of the upper surface of the flanges 14*d* and 14*e*, as illustrated, or the said upper surface of the block 16 may be slightly below the upper surface of the flanges 14*d* and 14*e*, to facilitate washing of the block 16.

The trough 14 is open at both its side edge regions.

In another embodiment, the block 16 and the base 14*a* are perforated, to allow atmosphere above the block 16 to be drawn into the plenum chamber, whilst in another embodiment, the work facility may comprise a simple perforated metal plate.

The second work facility 15 comprises a sink, with flanges 15*a*and 15*b* along its rear and forward edge regions respectively, the sink has a front to rear dimension which allows it to enter the central aperture in the plenum chamber, defined by the inner edge of the flange 12*d*, and the flanges 15*a* and 15*b* rest on the flange 12*d* to support the sink.

With the work facilities 14,15 located in the central opening of the plenum chamber 12, said central opening is substantially closed and, when the plenum chamber is connected to an evacuating source, as by a duct 17 having an inlet 17*a* open to the plenum chamber 12, atmosphere above the flange 12*a* is drawn into the plenum chamber 12 to remove contaminates from the atmosphere above said work facilities 14 and 15.

It should be observed that, when correctly located in the central opening in the flange 12*d*, the sink 15 has a depth which is less than that of the plenum chamber 12, the sink 15 does have a drain outlet 18 but does not have a drain connected thereto, and the plenum chamber 12 includes a liquid drain 21 therefore. Thus, the sink 15 has no permanent connections with the work station.

The work facilities 14, 15 have a combined width, relative to the cabinet 11, which is slightly less than the width of the central opening defined by the flange 12*d* and, as both work facilities 14 and 15 have no permanent connections with the work station, said work facilities are readily interchangeable.

Figure 2:
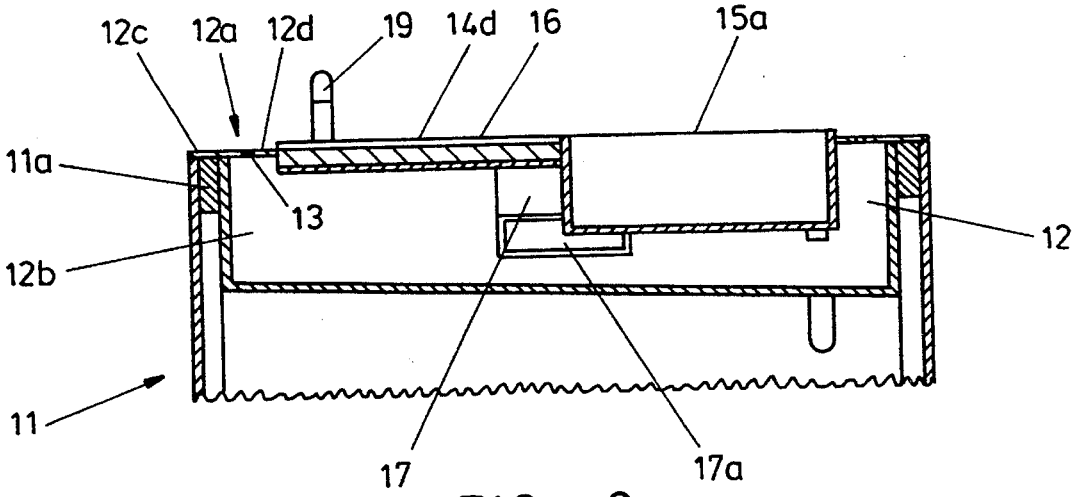
FIG. 2 is a cross-section of the upper regions of the work station shown in FIG. 1.
Figure 3:
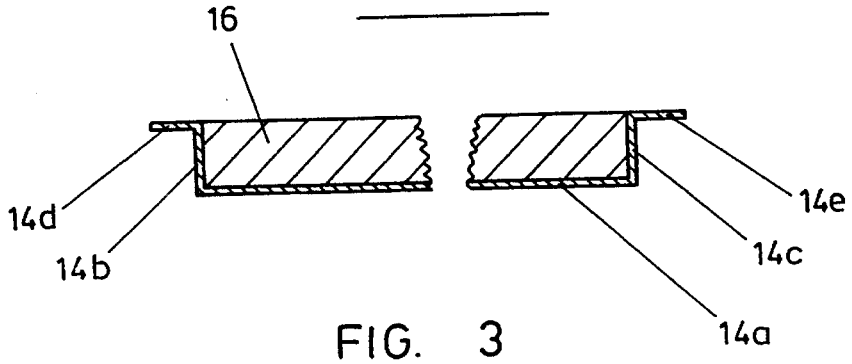
FIG. 3 is a cross-section through a flat working facility which can be used on the work station shown in FIG. 1.

In a work station having two work facilities, as illustrated in FIGS. 1 and 2, the cabinet may include two swivel taps 19, mounted on or adjacent the mid-width regions of the flange 12*d*, whereupon the sink 15 may be charged with water in both its possible work locations.

In another embodiment one or both taps 19 may be replaced by a flexible hose of a length to allow water to be supplied to any location on the upper surface of the cabinet 11.

In another embodiment in accordance with the invention the cabinet may support three or more work facilities and, by way of example, the cabinet 11 may support two flat work facilities, similar to work facility 14, and said work facilities 14 may be arranged with the sink 15 between them or with the two flat work facilities 14 in side by side relationship, with the sink 15 at one end or the other end thereof.

With such an arrangement three swivel taps 19 may be provided, one for each work facility, or a flexible extension pipe, may be connected to, or may replace, one or more taps 19, to allow the sink 15 to be filled in any of its three locations. For some such embodiments the flexible pipe may discharge through a spray device.

Further, whilst the block 16 has been illustrated as having a top surface 16*a* in the plane of the upper surface of flanges 14*d* and 14*e* the block 16 may not be rectangular and said block 16 may present any desired configuration on its top surface.

Vertical ventilated walls are well known in the art and one such ventilated wall be located along the rear of the cabinet 11 to increase the amount of air evacuated from above, the work facilities.

What is claimed is:

1. A work station which comprises:

(a) a support unit, which includes a liquid collection surface with a drain outlet, and which provides a horizontal support surface elevated above the liquid collection surface;

(b) at least two work facilities mounted removably in the support unit on the support surface, at least one of the at least two work facilities comprising a sink, the at least one of the at least two work facilities having a drain outlet through which liquid can drain from the work facility directly onto the collection surface of the support unit, for subsequent evacuation via the drain outlet of the collection surface, wherein the drain outlet of the collection surface of the support unit and the drain outlet of the work facility are spaced apart from one another vertically and are discrete;

(c) a plenum chamber defined within the support unit around said at least two work facilities when said facilities are mounted in the support unit; and (d) a plurality of openings formed through the horizontal support surface to provide fluid communication between space outside the support unit and said plenum chamber for ventilating said plenum chamber.

2. A work station as claimed in claim 1, in which the sink includes a draining surface formed integrally with it, on which articles can be placed for liquid to drain from them.

3. A work station as claimed in claim 1, in which the other work facility comprises a drainage surface, on which articles are adapted to be placed for liquid to drain from them.

4. A work station as claimed in claim 1, in which the other work facility comprises a flat surface.

5. A work station as claimed in claim 1, in which the liquid collection surface is a surface of the plenum chamber.

6. A work station as claimed in claim 1, further including means for supplying fluid to the work facilities.

7. A work station as claimed in claim 1 further comprising an evacuating duct having an inlet within said plenum chamber, wherein ventilating fluid passes through said openings into said plenum chamber and out of said plenum chamber through said evacuating duct.

* * * * *